US008802208B2

(12) United States Patent
Wochner

(10) Patent No.: US 8,802,208 B2
(45) Date of Patent: Aug. 12, 2014

(54) BREATHABLE GLOVE FOR USE IN PACKING AND SORTING HIGH-PURITY SILICON

(75) Inventor: Hanns Wochner, Burghausen (DE)

(73) Assignee: Wacker Chemie AG, Munich (DE)

( * ) Notice: Subject to any disclaimer, the term of this patent is extended or adjusted under 35 U.S.C. 154(b) by 583 days.

(21) Appl. No.: 12/895,923

(22) Filed: Oct. 1, 2010

(65) Prior Publication Data

US 2011/0083249 A1 Apr. 14, 2011

(30) Foreign Application Priority Data

Oct. 9, 2009 (DE) ..... 10 2009 045 538

(51) Int. Cl.
*B29D 22/00* (2006.01)
*A41D 19/00* (2006.01)

(52) U.S. Cl.
USPC ..... 428/36.1; 428/35.7; 2/161.6; 2/167

(58) Field of Classification Search
USPC ..... 428/35.7; 2/161.6, 167
See application file for complete search history.

(56) References Cited

U.S. PATENT DOCUMENTS

| | | | | |
|---|---|---|---|---|
| 4,643,791 | A | 2/1987 | Jurrius et al. | |
| 5,423,168 | A * | 6/1995 | Kolmes et al. | 57/229 |
| 2002/0174477 | A1* | 11/2002 | Hatch et al. | 2/160 |
| 2003/0037530 | A1 | 2/2003 | Zhu | |
| 2003/0159647 | A1* | 8/2003 | Arvidson et al. | 117/30 |
| 2005/0204451 | A1 | 9/2005 | Plut et al. | |
| 2007/0134486 | A1* | 6/2007 | Bansal et al. | 428/304.4 |
| 2008/0022436 | A1 | 1/2008 | Hull | |
| 2009/0007313 | A1 | 1/2009 | Boorsma et al. | |

FOREIGN PATENT DOCUMENTS

| | | | |
|---|---|---|---|
| AU | 2005100702 | A4 | 10/2005 |
| CN | 101397715 | A | 4/2009 |
| DE | 102005012078 | A | 8/2006 |
| JP | 63-500606 | A | 3/1988 |
| JP | 3006991 | U | 11/1995 |
| JP | 2004-179312 | A2 | 6/2004 |
| JP | 2004-538387 | A | 12/2004 |
| JP | 3137355 | U | 11/2007 |
| WO | 87/01073 | A1 | 2/1987 |
| WO | 2003/016602 | A1 | 2/2003 |

OTHER PUBLICATIONS

PatBase machine translation for JP 3137355, Abstract.

* cited by examiner

*Primary Examiner* — James Yager

(74) *Attorney, Agent, or Firm* — Brooks Kushman P.C.

(57) ABSTRACT

A breathable polyethylene glove as an overglove, over a cut- and puncture-resistant and nonfuzzing underglove, is useful for the non-contaminating packing of high-purity silicon, such as chunk polysilicon and silicon wafers.

5 Claims, No Drawings

BREATHABLE GLOVE FOR USE IN PACKING AND SORTING HIGH-PURITY SILICON

CROSS-REFERENCE TO RELATED APPLICATIONS

This application claims priority to German Patent Application No. DE 10 2009 045 538.8 filed Oct. 9, 2009 which is herein incorporated by reference.

BACKGROUND OF THE INVENTION

1. Field of the Invention

This invention relates to a breathable glove as an overglove, over a cut- and puncture-resistant and nonfuzzing underglove, for packing and sorting high-purity silicon, such as chunk polysilicon and silicon wafers.

2. Background Art

To avoid contamination of high-purity silicon in the course of manual packing and sorting, operators must wear gloves in principle. In order that glove-based contamination may be ruled out as well, gloves must ideally emit no particles when touching the silicon surface. Various measurements by manufacturers, for example KNF Clean Room Corp. and Icarus West Inc., have shown that gloves made of ultrapure polyethylene (PE) give best values in respect of particle emission per unit area for this. In this, they are far superior to other materials such as, for example, nylon, polyester, PVC, latex, polyurethane or gloves made of nitriles.

Regrettably, however, gloves made of ultrapure PE, preferably LDPE, have the disadvantage that they are not breathable and so the hands start to perspire after just a few minutes. Nor have PE gloves any cut resistance whatsoever. For this reason, safe handling of the extremely sharp silicon fragments with PE gloves requires a further, cut-resistant glove to be worn underneath.

Experience has shown that handling just a few kilograms of silicon fragments will cause the PE glove to tear and therefore require replacement. Owing to the very pronounced hand perspiration due to the PE overglove, the cut-resistant underglove likewise has to be changed after about 30 minutes.

Operators are therefore instructed to examine their PE gloves for damage at intervals of one minute. Overlooked damage risks human perspiration, which contains sodium chloride, coming into contact with the high-purity silicon and thereby rendering it unuseable. Measurements conducted in the course of the on-going operation again and again show sodium traces on the silicon fragments, attributable to perspiration from the packers and/or the sorters.

A further disadvantage with the use of PE gloves is that the perspiring in the glove can lead, long term, to permanent, irreversible skin irritation.

Various solutions for breathable or cut-resistant gloves are known from the prior art. DE-102005044839, for instance, discloses a breathable glove having a silicone palm region area for improved grip and a backside region made of an air-permeable woven fabric. US2007028356 describes a multilayered breathable glove, the inner layer of which is breathable and the outer layer of which has a high coefficient of friction to allow very secure gripping therewith. However, no prior art glove combines good breathability with minimal particle emission of the glove palm area onto the piece to be grasped.

SUMMARY OF THE INVENTION

It is an object of the present invention to provide a glove for packing and sorting high-purity silicon that is superior with respect to particle emission PE per unit area, and is also breathable.

These and other objects are achieved, surprisingly, by joining a palm region area made of PE and a backside region made of a breathable cleanroom-grade textile fabric to form a glove for packing and sorting high-purity silicon that does not have the disadvantages of the prior art.

DETAILED DESCRIPTION OF THE PREFERRED EMBODIMENT(S)

The present invention accordingly provides a glove for use in packing and sorting high-purity silicon, wherein the palm region area of the glove consists of polyethylene and the backside region area of the glove consists of a breathable cleanroom-grade textile fabric, the two areas being permanently connected to each other.

In the glove of the present invention, the palm region area is made of ultrapure PE, preferably LDPE, and the upper side of the glove is made breathable. Attempts to achieve this through aperturing with holes on the upper side of the PE glove are unsuccessful, since the PE glove as a result becomes unstable and can tear very quickly when used to handle the silicon pieces.

Various breathable and cleanroom-grade textile fabrics can be used as material for the backside of the glove. Preference here is given to Tyvek® from DuPont, a fibrous functional textile which resembles a paper sheet and is composed of thermally welded fibers of high density polyethylene (HDPE).

Tyvek® is approximately as formable as, for example, paper, but is more robust. It is useful as a material for protective clothing because Tyvek® itself is substantially non-linting and the fibrous nonwoven web makes it virtually impossible for cells shed by the body to pass through the material to the outside. Sterile working conditions as needed in the abovementioned workspaces can be maintained. Owing to the material's breathability coupled with watertightness, gaseous perspiration can easily pass through the fiber to the outside.

Tyvek® can be welded to an ultrapure PE film so effectively as to obtain a glove having the same stability when handling polysilicon pieces as the purely PE glove. The welded seam between the textile material on the upper side (backside of the glove) and the high-purity LDPE on the palm region area of the glove has the same welded seam strength as the welded seam between the two PE films in a glove having palm-region and upper sides made of PE.

Welded seam strength was tested in accordance with DIN55543 Part 3. The glove of the present invention was found to have, at 50 N/15 mm, the same average welded seam strength between the upper side of Tyvek® and the underside of LDPE as a PE glove between LDPE films at the upper and undersides.

The glove of the present invention likewise requires, for safety reasons, the wearing of a cut- and puncture-resistant underglove underneath. The state of the art for suitable undergloves is a combination of three different glove types. A purely cotton glove is worn as first glove to wick up the perspiration. The cotton glove is covered with a cut-resistant glove, preferably make of an aramid fiber, more preferably of Kevlar® (DuPont). Since Kevlar® regrettably fuzzes, a nonfuzzing glove, preferably a vinyl glove, has to be worn on top. It is only then that the PE glove is used.

However, wearing four different gloves on top of each other has several disadvantages. First, several minutes are needed to properly put on these protective gloves and the many layers distinctly compromise dexterity. A further disadvantage is the high cost of four gloves for both hands that have to be replaced at regular intervals.

Surprisingly, the use of an underglove made of a high-strength polyethylene fiber having a very high tensile strength and additionally coated with polyurethane (PU) together with the use of the PE-Kevlar® glove of the present invention makes it possible to reduce the number of undergloves from three to one glove without reducing the protective effect and increasing perspiration.

The present invention further provides a multilayered glove for use in packing and sorting high-purity silicon, wherein the outer layer of the glove consists of a palm region area of polyethylene and the backside region area of the glove consists of a breathable cleanroom-grade textile fabric, the two areas being permanently connected to each other and at least one of the inner layers of the glove consisting of a high-strength polyethylene fiber having a very high tensile strength and coated with polyurethane.

Preference for use as high-strength polyethylene fiber is given to Dyneema® (DSM) which is additionally coated with PU (PU-Dyneema®). Particular preference is given to the PU coating of a seamless Dyneema® base fabric.

The two glove layers of the present invention can be worn as individual gloves, separately from each other, or else be firmly connected to each other. In addition to the two layers of the present invention, the glove may if desired contain still further inner layers above and/or below the high-strength layer of polyethylene fibers.

The use of the PU-Dyneema® material as inner glove or underglove combines cut resistance and puncture resistance with breathability coupled with low tendency to emit fuzz. Because the fibers are thin, dexterity is likewise very good. As a result, an appreciable increase in productivity is achieved over the prior art use of four different gloves. The gloves can be changed in a few seconds and procurement costs can be lowered.

Both the PU-Dyneema® material and Tyvek® can be used in all industrially customary fiber and nonwoven sizes for the gloves. The thicknesses of the materials can for example be matched to the specific use or else to the size of the gloves.

Embodiments of the present invention will now be more particularly described by way of example.

INVENTIVE EXAMPLE 1

A long-term test was carried out whereby 100 metric tons of polysilicon chunks of size 5 (average weight about 600 g, with an average edge length of 120 mm) were individually packed by hand in PE bags. The gloves used were the PE-Tyvek® gloves of the present invention combined with an underglove consisting of PU-Dyneema®. The consumption of PE-Tyvek® gloves amounted to 4466 pairs and the consumption of PU-Dyneema® undergloves amounted to 208 pairs.

COMPARATIVE EXAMPLE 1

Inventive Example 1 was repeated except that, in a further long-term test wherein 100 metric tons of polysilicon chunks of size 5 (average weight about 600 g, with an average edge length of 120 mm) were individually packed by hand in PE bags, the gloves used were purely PE gloves combined with an underglove consisting of PU-Dyneema®. The consumption of PE gloves amounted to 5067 pairs and the consumption of PU-Dyneema® undergloves amounted to 1123 pairs.

This comparative example shows that the use of the breathable PE-Tyvek® gloves of the present invention reduced the consumption of cut- and puncture-resistant undergloves of PU-Dyneema® by about 80%.

INVENTIVE EXAMPLE 2

In a class 100 cleanroom, 15 acid-etched chunk polysilicon pieces having a weight of 100 g per piece were handled for 30 seconds with an inventive glove consisting of PE-Tyvek®. A PU-Dyneema® was worn as underglove. The poly pieces were subsequently examined in respect of their metal surface contents. The results are contrasted in Table 1 with those of Comparative Example 2.

COMPARATIVE EXAMPLE 2

In a class 100 cleanroom, 15 acid-etched chunk polysilicon pieces having a weight of 100 g per piece were handled for 30 seconds with a purely PE glove. A PU-Dyneema® was likewise worn as underglove. The poly pieces were subsequently examined in respect of their metal surface contents. The results are contrasted in Table 1 with those of Inventive Example 2.

TABLE 1

Data in pptw (metal content on handled 100 g polysilicon piece)

| Glove type | Sodium | Titanium | Potassium | Aluminum |
|---|---|---|---|---|
| Measurement: median | | | | |
| PE-Tyvek ® | 6 | 8 | 3 | 4 |
| PE | 8 | 9 | 4 | 5 |
| Measurement: mean | | | | |
| PE-Tyvek ® | 6 | 11 | 7 | 6 |
| PE | 14 | 13 | 8 | 10 |

As expected, the measured sodium values are slightly lower for the PE-Tyvek® glove than for the purely PE glove in terms of the mean and the median.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A process for the manual handling of high-purity silicon pieces, comprising handling the high-purity silicon pieces by the gloved hands of a handler, a glove of the gloved hands comprising:

a) an overglove having a non-breathable palm region of LDPE film and a backside region of a breathable, thermally bonded non-woven web of HDPE fibers, the palm region welded to the non-woven web region; and b) a breathable underglove of ultra-high molecular weight polyethylene fibers coated with polyurethane.

2. The process of claim 1, further comprising inspecting at least the outerglove periodically following the handling of high-purity silicon for damage, and replacing damaged outergloves with new outergloves.

3. The process of claim 1, wherein the manual handling comprises manually packaging polysilicon chunks into a polyethylene bag.

4. A process for the manual packaging of high-purity silicon chunks, comprising gloving the hands of at least one handler with a glove comprising:

a) an overglove having a non-breathable palm region of LDPE film and a backside region of a breathable, thermally bonded non-woven web of HDPE fibers, the palm region welded to the non-woven web region;

b) a breathable underglove of ultra-high molecular weight polyethylene fibers coated with polyurethane; and the handler manually packing the high-purity silicon chunks into a polyethylene bag.

5. The process of claim 4, wherein the gloves of the handlers are inspected at intervals for damage, and if damaged, are replaced.

* * * * *